US010010228B2

(12) United States Patent
Rane

(10) Patent No.: US 10,010,228 B2
(45) Date of Patent: Jul. 3, 2018

(54) APPARATUS FOR ASSISTING TOILETING

(71) Applicant: Ajay Rane, Brisbane (AU)

(72) Inventor: Ajay Rane, Brisbane (AU)

( * ) Notice: Subject to any disclaimer, the term of this patent is extended or adjusted under 35 U.S.C. 154(b) by 0 days.

(21) Appl. No.: 15/554,168

(22) PCT Filed: Feb. 26, 2016

(86) PCT No.: PCT/AU2016/050128

§ 371 (c)(1),
(2) Date: Aug. 28, 2017

(87) PCT Pub. No.: WO2016/134425

PCT Pub. Date: Sep. 1, 2016

(65) Prior Publication Data

US 2018/0049610 A1 Feb. 22, 2018

(30) Foreign Application Priority Data

Feb. 27, 2015 (AU) ..... 2015900705

(51) Int. Cl.

| | |
|---|---|
| ***E03D 11/00*** | (2006.01) |
| ***A47K 17/02*** | (2006.01) |
| *A47C 16/02* | (2006.01) |
| *A47K 17/00* | (2006.01) |

(52) U.S. Cl.

CPC ..... *A47K 17/028* (2013.01); *A47C 16/025* (2013.01); *A47K 2017/006* (2013.01)

(58) Field of Classification Search

CPC ..... A47K 17/028; A47K 2017/006; A47K 16/025

USPC ..... 4/254

See application file for complete search history.

(56) References Cited

U.S. PATENT DOCUMENTS

| | | | | |
|---|---|---|---|---|
| 2,083,605 | A * | 6/1937 | Jertberg | A47K 17/028 297/423.45 |
| 6,148,448 | A * | 11/2000 | Urso | A47K 17/026 297/423.44 |
| 6,631,524 | B1 | 10/2003 | Dixon | 4/254 |
| 7,669,934 | B1 * | 3/2010 | Cline | A47C 7/503 297/217.3 |
| D698,163 | S | 1/2014 | Edwards | D6/349 |
| 8,707,473 | B2 * | 4/2014 | Rane | A47K 17/028 4/254 |
| 2013/0067649 | A1 | 3/2013 | Rane | 4/254 |

* cited by examiner

*Primary Examiner* — Huyen Le
(74) *Attorney, Agent, or Firm* — Stein IP, LLC

(57) ABSTRACT

An apparatus for assisting a person in assumption of a squat position for evacuations when using a toilet, the apparatus including a platform adapted to raise a user's feet from the ground surface, and at least one foot member, each having an opening therein to at least partially receive a portion of the toilet or bowl, and at least one height adjustment assembly to adjust the height of the platform above the at least one foot member, the height adjustment assembly including an upper leg mounted to the platform, a lower leg mounted to the at least one foot member for slidable movement relative thereto, a resilient separator to bias the platform and the at least one foot apart, and a locking mechanism to at least temporarily lock the upper leg relative to the lower leg to fix the height of the platform.

20 Claims, 7 Drawing Sheets

APPARATUS FOR ASSISTING TOILETING

CROSS-REFERENCE TO RELATED APPLICATIONS

This application is a national stage of International Application No. PCT/AU2016/050128, filed Feb. 26, 2016, which claims the benefit of priority to Australian Application No. 2015900705, filed Feb. 27, 2015, in the Australian Patent Office, the disclosures of which are incorporated herein in their entireties by reference.

TECHNICAL FIELD

The present invention relates to an apparatus for assisting a person in the assumption of a squat position for evacuations when using a toilet.

BACKGROUND ART

Virtually every physician and physiologist who has considered the subject agrees that squatting is one of the most natural and physiologically sound posture to use for evacuation.

Recent papers published by Rane et al and Gupta et al. show the benefits of squatting when urinating. Wennergren et al in 1984 have showed the benefits of foot support and leaning forward in children with bladder and bowel problems. Also a recent paper by El-Bahnasawy shows men urinate better in the sitting and leaning forward position than standing. All this research confirms the importance of squatting and foot support during urination in men, women and children There have been attempts in the past to configure toilets for use in the squat position or to assist users to adopt the squat position. One example is disclosed in International Patent Publication No. WO 2006/137047. This document teaches a water closet comprising a platform mountable over the toilet bowl and formed with a main opening therethrough aligned with the toilet bowl, said platform being constructed to support a user in a natural squatting defecation posture over said opening and over the toilet bowl, the middle front of a said platform in front of main opening occupied by a folded pan located to serve as urinal pan when the user is in the squatting position, said pan include side and front shields which are in operative vertical position prevent urine splashing outside of the urinal pan, the side shields mounted pivotally to said platform at the borders of pan to either operative approximately vertical or inoperative horizontal position, said front shield mounted pivotally in front of urinal pan to either operative vertical or to inoperative folded on the floor of urinal pan or on the backs of side shields position, said urinal pan include ropes which are connecting with one end to outer faces of side shields and with the other end to outer face of front shield thus securing concordant transverse of front and side shields from inoperable to operable position and vice versa.

Whilst directed to overcoming the problem, this device has a number of disadvantages including its complex nature, its lack of adjustment to account for people (and toilet pedestals) of different heights, and its intrusive aesthetic nature.

It will be clearly understood that, if a prior art publication is referred to herein, this reference does not constitute an admission that the publication forms part of the common general knowledge in the art in Australia or in any other country.

SUMMARY OF INVENTION

The present invention is directed to an apparatus for assisting a person in assumption of a squat position for evacuations when using a toilet, which may at least partially overcome at least one of the abovementioned disadvantages or provide the consumer with a useful or commercial choice.

With the foregoing in view, the present invention in one form, resides broadly in an apparatus for assisting a person in assuming a squat position for evacuations when using a toilet, the apparatus including a platform adapted to raise a user's feet from the ground surface, and at least one foot member, each having an opening therein to at least partially receive a portion of the toilet or bowl, and at least one height adjustment assembly to adjust the height of the platform above the at least one foot member, the height adjustment assembly including an upper leg mounted to the platform, a lower leg mounted to the at least one foot member for slidable movement relative thereto, a resilient separator to bias the platform and the at least one foot apart, and a locking mechanism to at least temporarily lock the upper leg relative to the lower leg to fix the height of the platform.

Use of the device of the present invention will preferably position the user's pelvis in the optimum position for evacuation. The optimum position is anteversion or near squat (knees above the Anterior Superior Iliac Spine (ASIS) with a full squat more preferred but fewer user's particularly Western users will be physically able to assume this position. The position assumed will therefore typically be anteverted and as close as possible to a full squat.

The apparatus of the present invention includes a platform. The platform will typically include a substantially planar upper surface. The platform will also preferably be suitably sturdy in order to maintain its shape and position under the weight of a person, even if the entire weight of the person is placed on to the platform. According to a particularly preferred invention, the platform is typically rated to 150 kg.

Normally, the upper surface of the platform will be adapted to have a user's feet placed thereon during use. The upper surface of the platform may therefore be provided with marking indicia to indicate that the "correct" position of the feet during use. There may be different indicia provided for use of the platform on by a child in contrast to use by an adult. The marking indicia may be of any form, including embossing the marking indicia onto the surface. Alternatively, the marking indicia may be depressions. Preferably, the marking indicia will be foot-shaped markings.

The platform is preferably provided with arcuate edges in order to minimise the chance of injury to a user when using the apparatus. The platform may be of any shape, although a generally rectangular shape, when viewed in plan, is preferred. In this form, the platform will normally have a pair of side edges, a front edge and upper and lower surfaces. The front or forward corners of the platform will generally be rounded when viewed in plan.

The platform included in the present invention includes an opening to at least partially receive a portion of the toilet or bowl. The opening will normally be in a rear portion of the platform. The opening may have any shape, but will preferably have an at least partially arcuate portion given that most toilet bowls have a rounded appearance. The opening will normally be shaped and sized to fit a majority of toilets. A portion of the opening may in use, abut the toilet or bowl but this is not necessarily the case. However, a portion of the opening/platform will preferably abut the toilet or bowl when the platform is raised in order to stabilise the platform.

It is particularly preferred that the height adjustable assembly is fixable or lockable to at least temporarily fix the height of the platform. Preferably, a single height adjustment assembly is provided. It is preferred that the single height adjustment assembly is approximately centrally located between the upper platform and the at least one foot member.

According to a particularly preferred embodiment, the height adjustment assembly includes an upper leg and a lower leg. Preferably, the lower leg is substantially tubular and hollow and receives at least a portion of the upper leg thereinto. The upper leg is also preferably tubular and hollow. Normally, both the upper and lower legs are substantially cylindrical but any shape can be used. Although the lower leg may be smaller than the upper leg and may be received into the upper leg, for reasons that will be come clearer below (with respect to the preferred locking mechanism) that configuration is less preferred than a lower leg that receives an upper leg.

Preferably, a number of openings are typically provided into, and preferably through the lower leg. Normally, at least three openings are provided and preferably, more than three openings will be provided with the number of openings effectively setting the number of different heights at which the platform can be fixed. The openings will normally be provided in a series which is vertically spaced over at least a portion of the lower leg. Preferably, the openings are evenly spaced from one another.

It is further preferred that the openings are slot openings extending circumferentially. As will be seen from the explanation below, the height of the slot openings will be chosen particularly to match the dimension of an engagement finger which is received into one of the slot openings but the provision of openings which extend circumferentially, allows some tolerance for orientation of the platform.

Preferably, the slot openings are forwardly facing, that is in a forward side of the lower leg, away from the toilet when the device is in use but the openings could be on any side of the lower leg.

Preferably, the lower leg will include an inner, radially extending rim in order to prevent the upper leg from separation or removal from the lower leg in that direction. The lower leg will normally be manufactured of a suitable material such as metal.

The upper leg will also be manufactured of a suitable material such as metal. The upper leg will also typically be hollow. The upper leg will normally be provided with a lower rim extending radially outwardly in order to abut the inner rim on the lower leg to define the absolute height of the height adjustment assembly. The upper leg is preferably dimensioned to be closely received within the lower leg.

Normally, the height adjustable assembly will allow the platform to be fixed at a number of predetermined heights, such as at approximately 80 mm, approximately 150 mm, approximately 230 mm and approximately 400 mm. Normally, the maximum height at which the platform can be located will be at or slightly beneath the upper edge of the toilet bowl. Most countries have a reasonably standard height of toilet bowl and the apparatus of the invention is preferably adaptable to suit.

A resilient separator is preferably provided in the height adjustable assembly. The resilient separator may be of any type and preferably, the separator is located with the height adjustment assembly. The resilient separator may be located inside or outside the upper and/or lower leg. The resilient separator is preferably biased into the extended condition which means that the platform is typically fully raised above the at least one foot member. The simplest resilient separator that can be used is an externally, concentrically mounted spring which is located about the upper and lower legs between the platform and the at least one foot portion, acting to bias the platform away from the at least one foot member. Alternatively, a ram or similar could be provided within the tubular upper and/or lower legs to achieve this purpose.

According to the above, a locking mechanism is preferably provided for the height adjustable means in order to lock the platform at a particular height above the at least one foot member (and the ground surface). Preferably, the locking mechanism will lock the device against the resilient force of the separator such that if the lock is disengaged, the platform will rise due to the force applied by the resilient separator.

According to a particularly preferred embodiment, the locking mechanism includes an elongate lever. Preferably, an upper end of the lever extends through an opening provided in the platform in order to allow manual actuation of the lever by a user. The lever is preferably mounted within the upper leg. Preferably, the lever is mounted about a pivot pin or point allowing the lever to reciprocate to move an engagement finger between an engaged condition to lock the height of the assembly and a disengaged condition allowing movement of the height adjustment assembly.

Normally, the pivot pin extends from an inner side wall of the upper leg and is located substantially perpendicularly to the openings in the lower leg. The pivot pin typically extends inwardly into the upper leg in order to position the lever and particularly the lower end of the lever substantially centrally. The lower end of the lever is preferably located adjacent a series of openings in the lower leg.

The lever is preferably elongate. As mentioned above, the lever preferably extends from above an upper surface of the platform to below the lower end of the upper leg in order to allow engagement of the engagement finger with the openings in the lower leg. The lever can have any shape but is typically substantially cylindrical.

The engagement finger is typically associated with the lower end of the lever. The engagement finger is preferably pivotally mounted to the lever about a pivot pin. The engagement finger is provided to be received at least partially within an opening in the series of openings in the lower leg. Movement of the lever preferably engages and disengages the engagement finger from the opening.

Preferably, the engagement finger is shaped to allow insertion into the opening into which it is located. The finger will preferably have a rounded end. The elongate finger is preferably dimensioned to be closely received in an opening in a vertical direction. This may assist with the security of the engagement and also minimise rattling which may be offputting to users.

An engagement assembly may be provided on the engagement finger. For example, each of the openings may have a peripheral groove, slot or rebate. The elongate finger may then be provided with one or more spring-loaded ball bearings for example or other members, biased outwardly such that when the engagement finger is forced into an opening, the spring-loaded ball bearings are temporarily forced inwardly to allow passage of the engagement finger into the opening and then returned once in the peripheral groove or rebate in order to hold the engagement finger in the opening against accidental but not determined dislodgement.

According to an alternative embodiment, the elongate lever may be provided within or at least partially within a portion of an outer tubular leg member and adapted for rotation about a substantially vertical axis. An engagement finger is preferably provided on or adjacent to a lower end of the elongate lever of this embodiment. Rotation of the elongate lever in a first direction will preferably move the engagement finger into a position to engage with an inner leg member (or portion mounted or attached thereto) and rotation of the elongate lever in a second, opposite direction will typically move the engagement finger out of engagement with the inner leg member (or portion mounted or attached thereto). According to this alternative embodiment, the inner leg member will typically have a series of openings into or through the inner leg member into which the engagement finger can be moved as required by the user. According to this embodiment, the resilient separator may be entirely within the inner leg member which is also preferably tubular.

According to a preferred embodiment, a latch or other mechanism may be provided relative to or on that portion of the lever extending above the upper surface of the platform in order to minimise accidental dislodgement of the lever and thereby the engagement finger whilst the devices in use. In this regard, the latch may require the use of both hands in order to disengage the latch to allow movement of the lever.

The apparatus of the invention preferably further includes a substantially planar foot portion. The foot portion preferably corresponds in size and shape to the platform. Normally, the height adjustment assembly is located between the foot portion and the platform, that is, preferably extend between an upper portion of the foot portion and a lower portion of the platform. According to an embodiment, a lower portion of the height adjustable assembly may extend partially into or through the foot portion.

When fully lowered, the platform and foot portion will normally form an apparatus of approximately 80-100 mm in height. The platform and/or the foot portion may be provided with opening(s) therein in order to receive the collapsed height adjustment means.

The platform may be provided with handles in order to assist the user with maintaining their balance on the apparatus.

It is also preferred that the apparatus of the present invention may be adapted to support the user's weight such that the user does not contact the toilet bowl or opening during use of the device.

The foot portion will also preferably have an opening to at least partially receive the toilet or bowl. The opening in the foot portion will preferably be shaped similarly to the opening in the platform although the openings may not necessarily have the same shape. In particular, the opening in the foot portion is preferably shaped to abut the toilet in order to assist with the correct positioning of the apparatus relative to the toilet for use.

Normally, the height adjustment assembly is attached to both the platform and foot. Such attachment may be either temporary or permanent attachment.

In use, the apparatus of the invention is placed adjacent a toilet and the platform is raised to a height which, when a user places their feet on the platform in the designated positions, the user will by default, assume at least partially squatting position in order to achieve the advantages of this position. The height of the apparatus may be adjusted to assume a more shallow or more deeply squatting position.

This adjustment can provide advantages for a number of reasons including the ability to adjust the height of the platform in order that a user to become comfortable in assuming a squat position and adjusting the depth of the squat as required.

However, some users, for example women and children, may have difficulty in achieving a full squat, even though the full squat position is most beneficial for women in particular. The adjustable nature of the invention allows a gradual increase in the depth of squat achieved. It also allows a comfortable depth squat to be assumed.

The invention preferably therefore provides an apparatus and method of use thereof which assists a user to assume three main positions, namely the "correct", semi-squat and full squat positions, but any intervening position as well due to the adjustable nature of the device. The apparatus can be adjusted to suit use by children, females and males to account for their different anatomy and idiosyncratic factors such as flexibility and comfort in different depth squat positions.

Any of the features described herein can be combined in any combination with any one or more of the other features described herein within the scope of the invention.

The reference to any prior art in this specification is not, and should not be taken as an acknowledgement or any form of suggestion that the prior art forms part of the common general knowledge.

BRIEF DESCRIPTION OF DRAWINGS

Preferred features, embodiments and variations of the invention may be discerned from the following Detailed Description which provides sufficient information for those skilled in the art to perform the invention. The Detailed Description is not to be regarded as limiting the scope of the preceding Summary of the Invention in any way. The Detailed Description will make reference to a number of drawings as follows.

DESCRIPTION OF EMBODIMENTS

Figure 1:
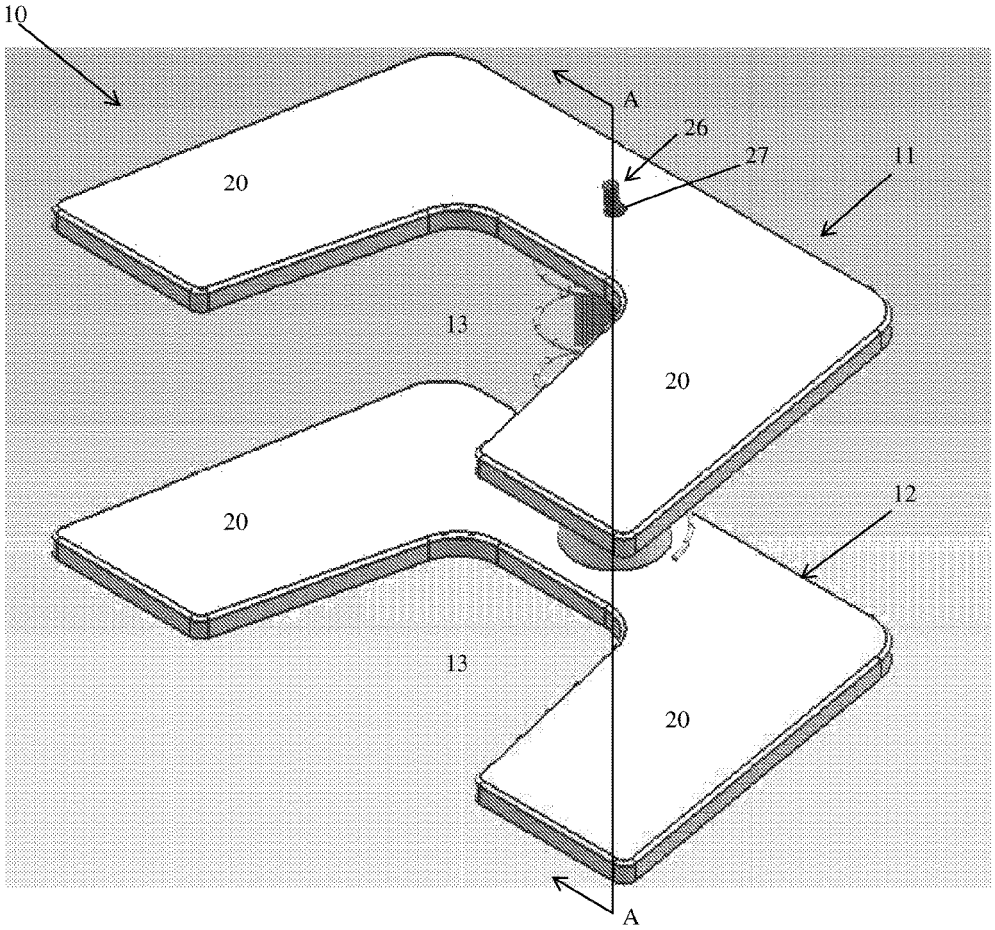
FIG. 1 is an isometric view of a device according to a particularly preferred embodiment of the present invention.
Figure 2:
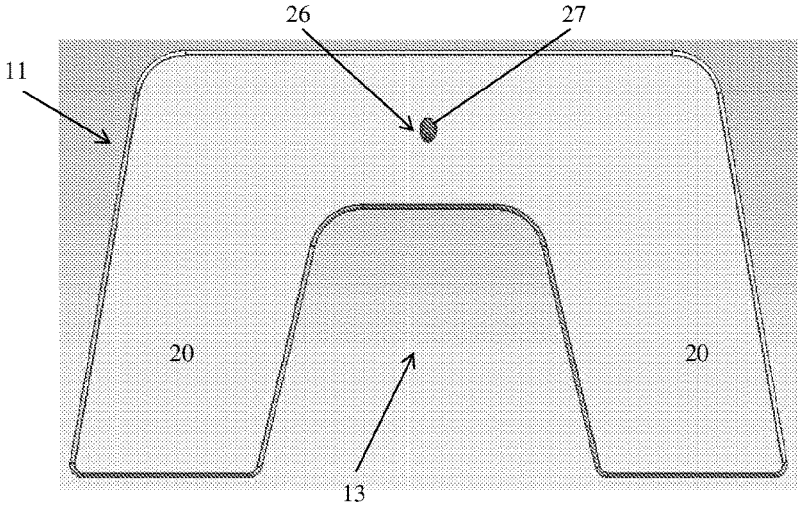
FIG. 2 is a plan view of the device illustrated in FIG. 1.

According to a particularly preferred embodiment of the present invention, an apparatus 10 for assisting a person in assumption of a squat position for evacuations when using a toilet, is provided.

The preferred embodiment of the apparatus 10 illustrated in the Figures includes an upper platform 11 adapted to raise a user's feet from the ground surface, and a foot member 12, each having an opening 13 therein to at least partially receive a portion of the toilet or bowl, and a height adjustment assembly 14 to adjust the height of the platform 11 above the foot member 12. The height adjustment assembly 14 includes an upper leg 15 mounted to the platform 11, a lower leg 16 mounted to the foot member for slidable movement relative to the upper leg 15, a resilient separator 17 to bias the platform 11 and the foot member 12 apart, and a locking mechanism to at least temporarily lock the upper leg 15 relative to the lower leg 16 to fix the height of the platform 11.

In use, the apparatus of the invention is placed adjacent to a toilet and the platform 11 is raised to a height which, when a user places their feet on the platform 11, the user will by default, assume an at least partially squatting position in order to achieve the advantages of this position. The height of the apparatus may be adjusted to assume a more shallow or more deeply squatting position.

Use of the device of the present invention will preferably position the user's pelvis in the optimum position for evacuation. The optimum position is anteversion or near squat (knees above the Anterior Superior Iliac Spine (ASIS) with a full squat more preferred but fewer user's particularly Western users will be physically able to assume this position. The position assume will therefore typically be anteverted and as close as possible to a full squat.

Figure 4:
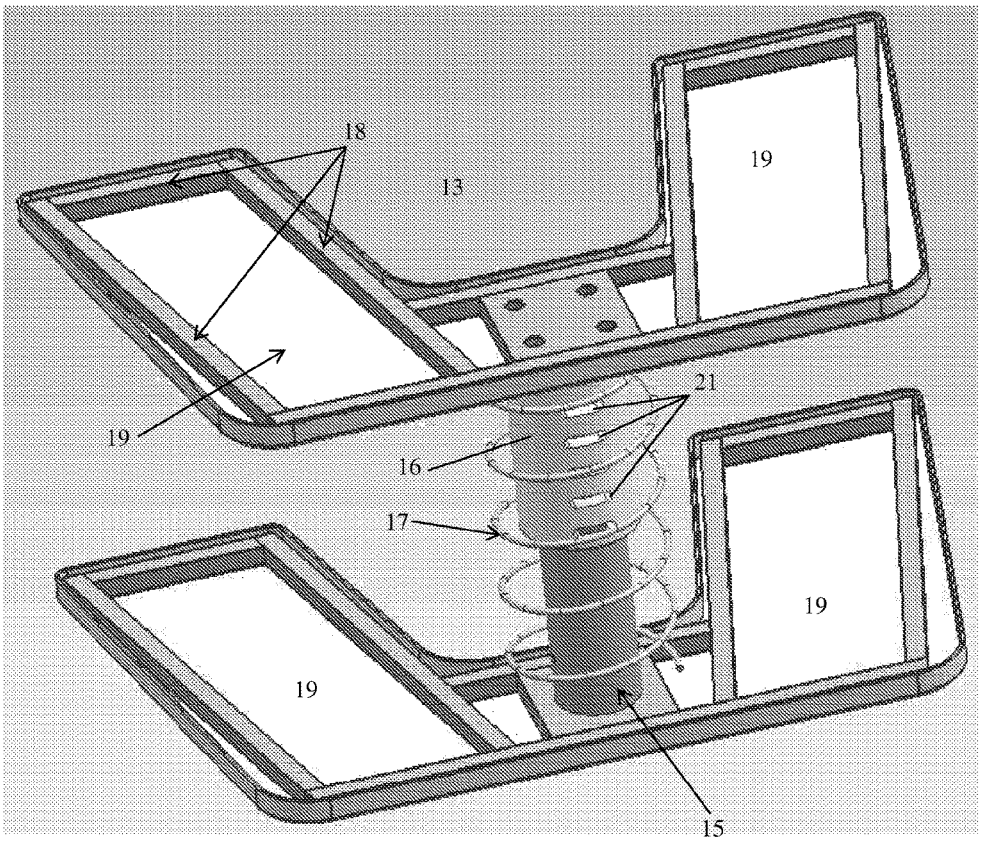
FIG. 4 is a view of the device illustrated in FIG. 1 from the underside.
Figure 5:
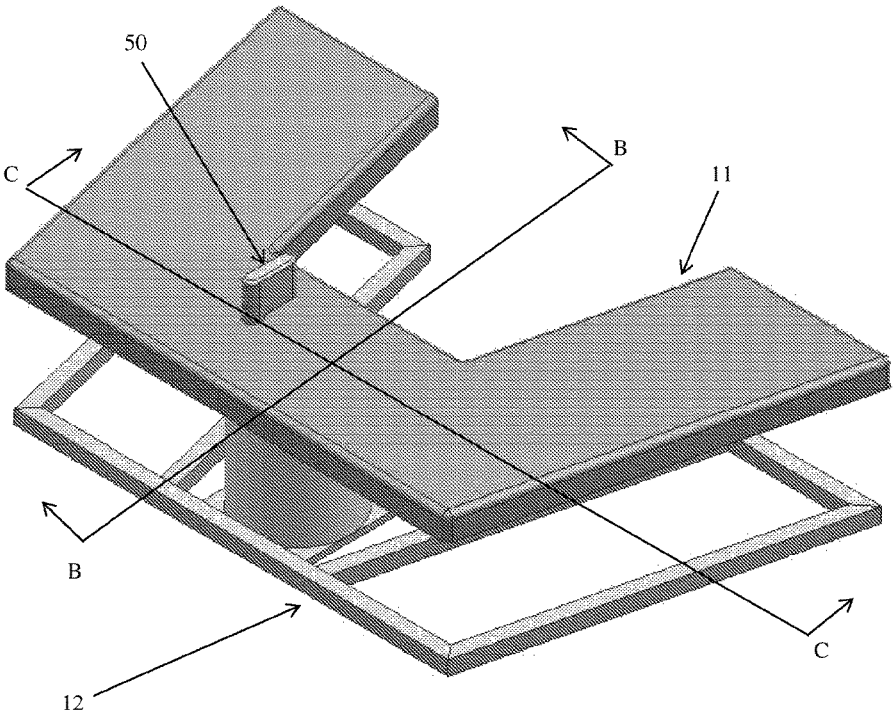
FIG. 5 is an isometric view of a device according to an alternative preferred embodiment of the present invention.
Figure 6:
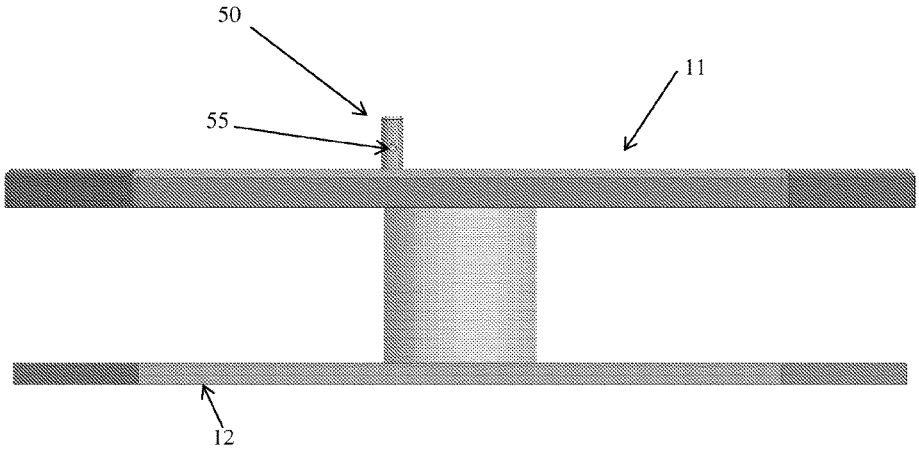
FIG. 6 is a front elevation view of the device illustrated in FIG. 5.
Figure 7:
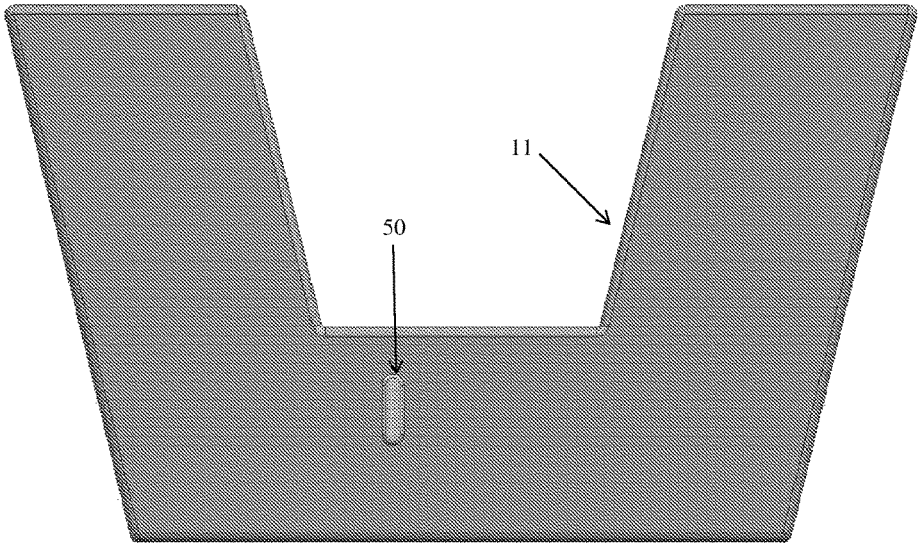
FIG. 7 is a plan view of the device illustrated in FIG. 5.
Figure 8:
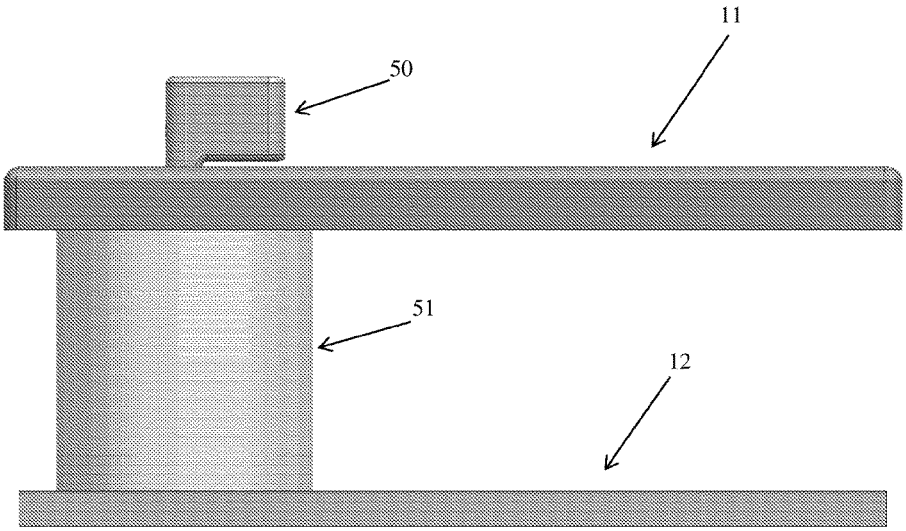
FIG. 8 is a side elevation view of the device illustrated in FIG. 5.
Figure 9:
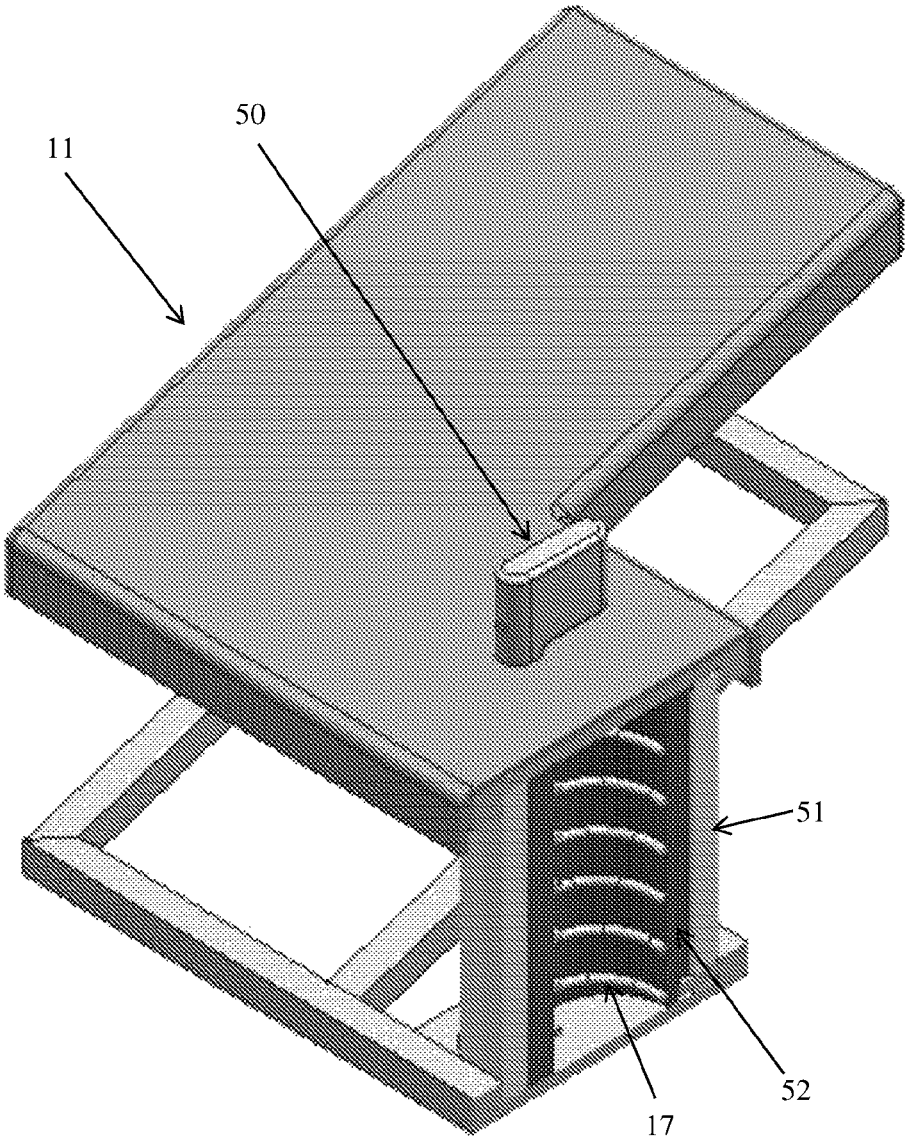
FIG. 9 is a sectional isometric view of the device illustrated in FIG. 5 along line B-B.
Figure 10:
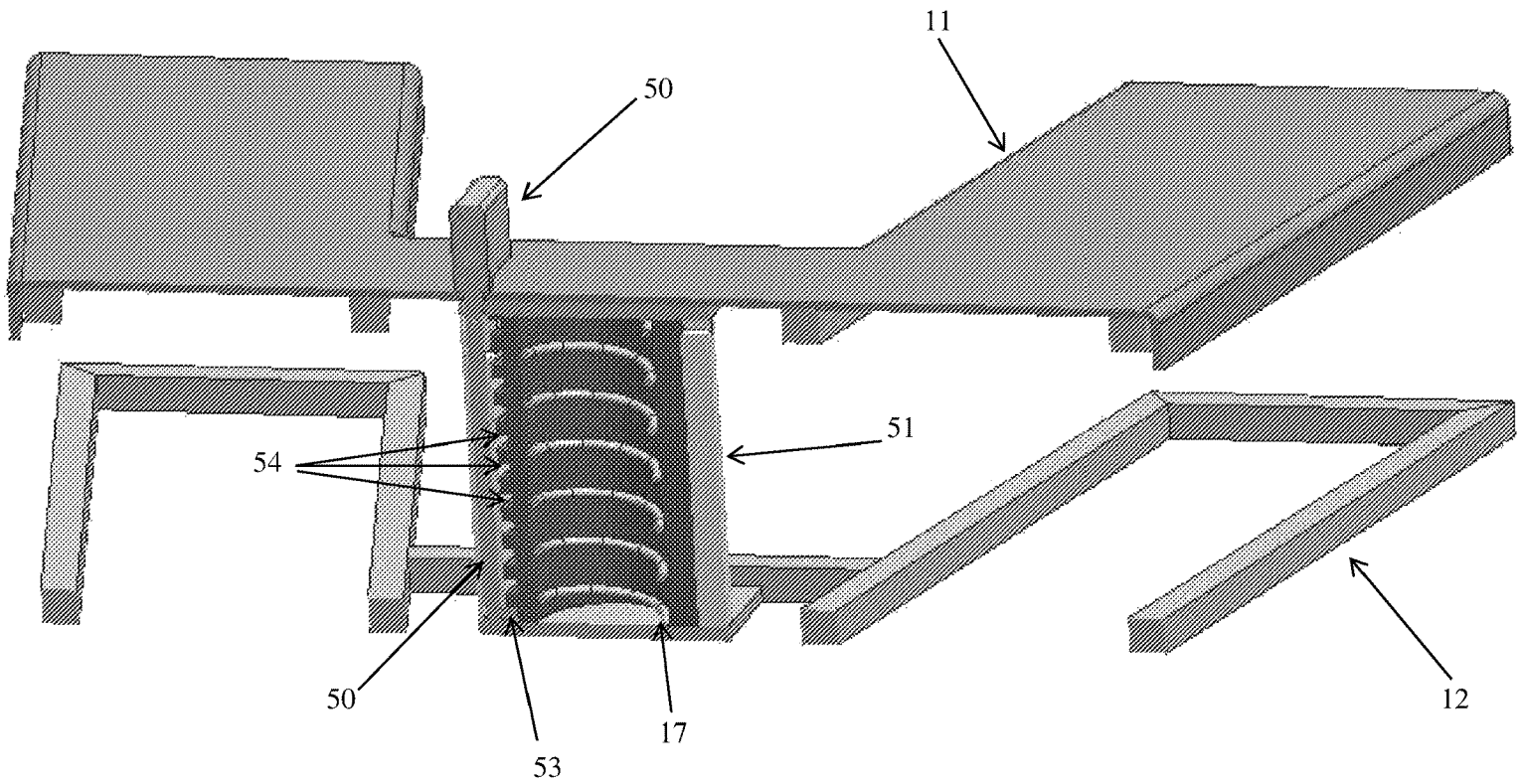
FIG. 10 is a sectional isometric view of the device illustrated in FIG. 5 along line C-C.

As illustrated, the platform 11 includes a substantially planar upper surface. The platform 11 will also preferably be suitably sturdy in order to maintain its shape and position under the weight of a person, even if the entire weight of the person is placed on to the platform. According to a particularly preferred invention, the platform is typically rated to 150 kg. This load bearing sturdiness and relatively lightweight is preferably achieved though the manufacture of the platform and the foot member using a frame and cover as illustrated in FIG. 4. The frame members 18 provide the required strength and the cover 19 on each of the platform 11 and the foot member 12 allows a reduction in weight.

The upper surface of the platform 11 is adapted to have a user's feet placed thereon during use. The upper surface of the platform may therefore be provided with marking indicia to indicate that the "correct" position of the feet during use. There may be different indicia provided for use of the platform on by a child in contrast to use by an adult.

The platform 11 is normally provided with arcuate edges in order to minimise the chance of injury to a user when using the apparatus. The platform 11 has a pair of side edges, a front edge and upper and lower surfaces. The front corners of the platform will generally be rounded when viewed in plan.

The platform 11 includes an opening 13 to at least partially receive a portion of the toilet or bowl. The opening 13 is in a rear portion of the platform 11. The opening 13 will preferably have an at least partially arcuate portion given that most toilet bowls have a rounded appearance. The opening 13 will normally be shaped and sized to fit a majority of toilets. A portion of the periphery of the opening 13 may in use, abut the toilet or bowl when the platform is raised in order to stabilise the platform. As illustrated, the platform has a pair of side portions 20, one to either lateral side of the opening 13. It is generally these portions 20 upon which a user will place their feet during use of the apparatus.

It is particularly preferred that the height adjustable assembly 14 is fixable or lockable to at least temporarily fix the height of the platform 11. As illustrated, a single height adjustment assembly 14 is provided approximately centrally located between the upper platform 11 and the foot member 12.

The lower leg 16 of the illustrated height adjustable assembly 14 is substantially tubular and hollow and receives at least a portion of the upper leg 15 thereinto. The upper leg 15 is also tubular and hollow. Normally, both the upper 15 and lower legs 16 are substantially cylindrical but any shape can be used.

Figure 3:
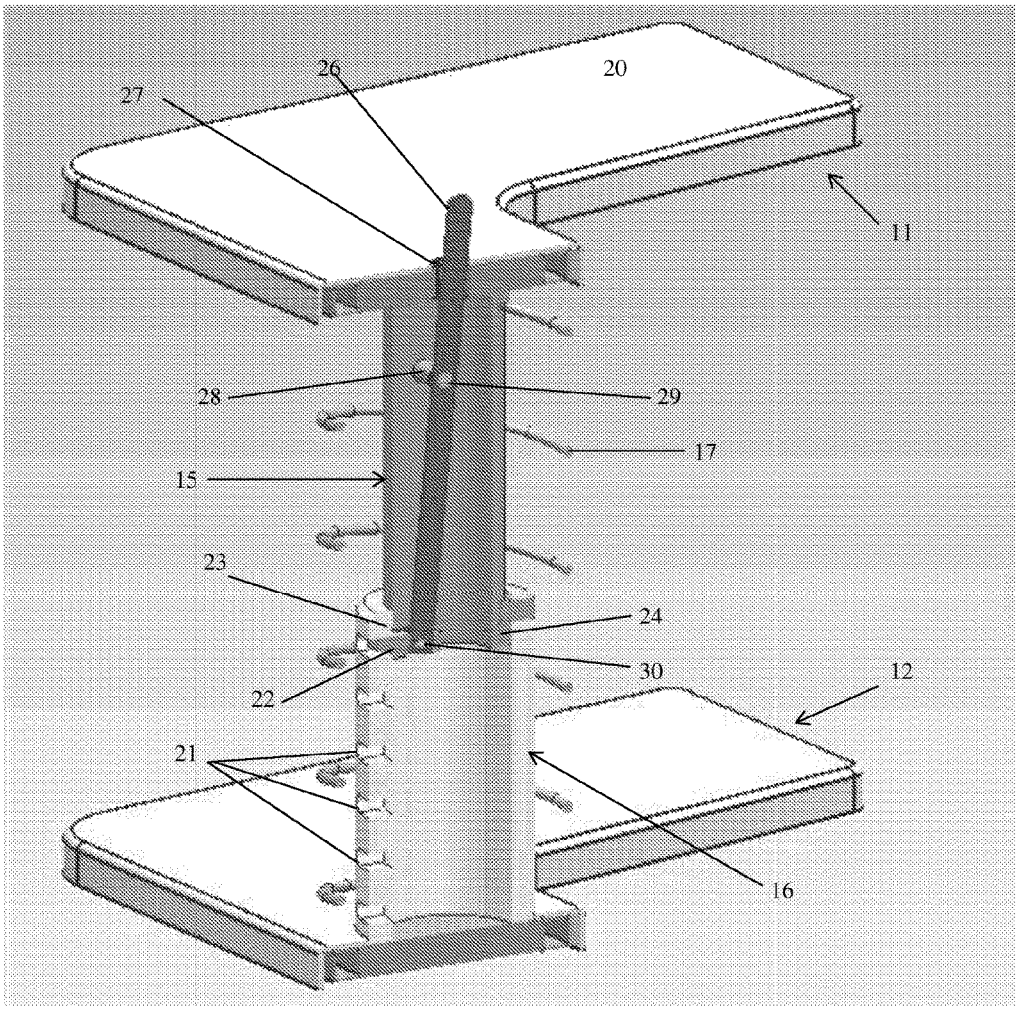
FIG. 3 is a sectional view of the device illustrated in FIG. 1 along line A-A.

As best shown in FIGS. 3 and 4, a number of openings 21 are typically provided through the lower leg 16. The openings 21 are provided in a series which is evenly and vertically spaced over at least a portion of the lower leg 16.

The openings 21 are slot openings extending circumferentially. The height of the slot openings 21 is chosen particularly to match an engagement finger 22 which is received into one of the slot openings 21 but the shape of the openings 21 which extend circumferentially allows some tolerance for orientation of the platform 11.

The openings 21 are forwardly facing, that is in a forward side of the lower leg 16 away from the toilet when the device is in use.

The lower leg 16 also includes an inner, radially extending rim 23 at an upper end in order to prevent the upper leg 15 from separation or removal from the lower leg 16 in that direction. The lower leg 16 will normally be manufactured of a suitable material such as metal.

The upper leg 15 will also be manufactured of a suitable material such as metal. The upper leg is also hollow and is provided with a lower rim 24 extending radially outwardly in order to abut the inner rim 23 on the lower leg 16 to define the absolute height of the height adjustment assembly. The upper leg 15 is dimensioned to be closely received within the lower leg 16.

Normally, the height adjustable assembly 14 allows the platform to be fixed at a number of predetermined heights, such as at approximately 80 mm, approximately 150 mm, approximately 230 mm and approximately 400 mm. Normally, the maximum height at which the platform can be located will be at or slightly beneath the upper edge of the toilet bowl. Most countries have a reasonably standard height of toilet bowl and the apparatus of the invention is preferably adaptable to suit.

A resilient separator 17 is provided in the height adjustable assembly 14. The resilient separator 17 is located with the height adjustment assembly and is biased into the extended condition which means that the platform 11 is typically fully raised above the foot member 12. The simplest resilient separator that can be used is an externally, concentrically mounted spring as illustrated in the Figures, which is located about the upper 15 and lower legs 16 between the platform 11 and the foot member 12, acting to bias the platform 11 away from the foot member 12.

A locking mechanism is provided for the height adjustable assembly in order to lock the platform 11 at a particular height above the foot member 12 (and the ground surface) against the resilient force of the separator 17 such that if the lock is disengaged, the platform 11 will rise due to the force applied by the resilient separator 17.

According to the illustrated embodiment, the locking mechanism includes an elongate lever 25. Preferably, an upper end 26 of the lever 25 that extends through an opening 27 provided in the platform 11 in order to allow manual actuation of the lever 25 by a user. The lever 25 is mounted within the upper leg 15 about a pivot pin 28 allowing the lever 25 to reciprocate to move the engagement finger 22 between an engaged condition to lock the height of the assembly and a disengaged condition allowing movement of the height adjustment assembly.

As best illustrated in FIG. 3, the pivot pin 28 extends from an inner side wall of the upper leg 15 and is located substantially perpendicularly to the openings 21 in the lower leg 16 to allow rotation of the lever 25 about a pivot axis 29.

The pivot pin 28 extends inwardly into the upper leg 15 in order to position the lever 25 and particularly the lower end of the lever, substantially centrally. The lower end of the lever 25 is located adjacent a series of openings 21 in the lower leg 16.

The lever 25 is elongate. As illustrated in FIG. 3, the lever 25 extends from above of an upper surface of the platform 11 to below the lower end of the upper leg 16 in order to allow engagement of the engagement finger 22 with the openings 21 in the lower leg 16. The lever 25 can have any shape but is typically substantially cylindrical.

The engagement finger 22 is pivotally mounted to the lever 25 about a pivot pin 30. The engagement finger 22 is to be received at least partially within an opening 21 in the series of openings 21 in the lower leg 16. Movement of the lever 25 preferably disengages the engagement finger 22 from the opening 21.

Preferably, the engagement finger 22 is shaped to allow insertion into the opening 21 into which it is located. The engagement finger 22 will preferably have a rounded end. The engagement finger 22 is preferably dimensioned to be closely received in an opening 21 vertically. This may assist with the security of the engagement and also minimise rattling which may be offputting to users.

The apparatus of the invention preferably further includes a substantially planar foot member 12. The foot 12 preferably corresponds in size and shape to the platform 11. Normally, the height adjustment assembly 14 is located between the foot 12 and the platform 11, that is, preferably extend between an upper portion of the foot 12 and a lower portion of the platform 11.

When fully lowered, the platform and foot portion will normally form an apparatus of approximately 80-100 mm in height. The platform and/or the foot portion may be provided with opening(s) therein in order to receive the collapsed height adjustment means.

It is also preferred that the apparatus of the present invention may be adapted to support the user's weight such that the user does not contact the toilet bowl or opening during use of the device.

The foot portion also has an opening 13 to at least partially receive the toilet or bowl. The opening 13 in the foot 12 is shaped similarly to the opening in the platform 11 although the openings 13 may not necessarily have the same shape. In particular, the opening in the foot portion is preferably shaped to abut the toilet in order to assist with the correct positioning of the apparatus relative to the toilet for use.

According to the alternative embodiment illustrated in FIGS. 5 to 10, the elongate lever 50 is provided within or at least partially within a portion of an outer tubular leg 51 and is adapted for rotation about a substantially vertical axis but fixed from moving longitudinally. An engagement finger 53 is provided adjacent to a lower end of the elongate lever 50 of this embodiment. Rotation of the elongate lever 50 in a first direction moves the engagement finger 53 into a position to engage with an inner leg member 52 and rotation of the elongate lever 50 in a second, opposite direction moves the engagement finger 53 out of engagement with the inner leg member.

According to this alternative embodiment, the inner leg member 52 has a series of openings 54 into or through the inner leg member 52 into which the engagement finger 53 can be moved as required by the user. According to this embodiment, the resilient separator 17 is located within the inner leg 5 which is also preferably tubular. The user will apply force as necessary to the upper platform 11 when the engagement finger 53 is disengaged from the openings 54, allowing movement of the upper platform 11 to a desired height where the height can be fixed by rotation of the elongate lever 50 to engage the engagement finger 53 in the appropriate opening 54.

This embodiment also includes an indicator 55 on the lever to indicate whether the lever is in the engaged (red colour) or disengaged condition (green colour).

In the present specification and claims (if any), the word 'comprising' and its derivatives including 'comprises' and 'comprise' include each of the stated integers but does not exclude the inclusion of one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

In compliance with the statute, the invention has been described in language more or less specific to structural or methodical features. It is to be understood that the invention is not limited to specific features shown or described since the means herein described comprises preferred forms of putting the invention into effect. The invention is, therefore, claimed in any of its forms or modifications within the proper scope of the appended claims (if any) appropriately interpreted by those skilled in the art.

The invention claimed is:

1. An apparatus for assisting a person in assumption of a squat position for evacuations when using a toilet, the apparatus including a. a platform adapted to raise a user's feet from the ground surface, and b. at least one foot member, each having an opening therein to at least partially receive a portion of the toilet or bowl, and c. at least one height adjustment assembly to adjust the height of the platform above the at least one foot member, the height adjustment assembly including i. an upper leg mounted to the platform, ii. a lower leg mounted to the at least one foot member for slidable movement relative thereto, iii. a resilient separator to bias the platform and the at least one foot apart, and iv. a locking mechanism to at least temporarily lock the upper leg relative to the lower leg to fix the height of the platform, wherein the locking mechanism includes an elongate lever, an upper end of which extends through an opening provided in the platform in order to allow manual actuation of the lever by a user.

2. An apparatus as claimed in claim 1 wherein the upper surface of the platform is provided with marking indicia to indicate that the correct position of a user's feet during use.

3. An apparatus as claimed in claim 1 wherein a single height adjustment assembly is provided approximately centrally, between the upper platform and the at least one foot member.

4. An apparatus as claimed in claim 1 wherein the height adjustment assembly includes at least one upper leg and at least one lower leg, telescopically located relative to one another.

5. An apparatus as claimed in claim 4 wherein a number of openings are provided at least into one of the at least one lower legs with the number of openings effectively setting the number of different heights at which the platform can be fixed.

6. An apparatus as claimed in claim 5 wherein the openings will normally be provided in a series which is vertically spaced over at least a portion of the lower leg, send openings being evenly spaced from one another.

7. An apparatus as claimed in claim 5 wherein the openings are slot openings extending circumferentially.

8. An apparatus as claimed in claim 7 wherein the slot openings are dimensioned to match the dimension of an engagement finger which is received into one of the slot openings.

9. An apparatus as claimed in claim 4 wherein at least one of the lower legs include an inner, radially extending rim in order to prevent the at least one upper leg from separation or removal from the at least one lower leg in that direction.

10. An apparatus as claimed in claim 9 wherein the at least one upper leg is provided with a lower rim extending radially outwardly to abut the inner rim on the at least one lower leg to define an absolute height of the height adjustment assembly.

11. An apparatus as claimed in claim 4 wherein a resilient separator is located about the upper and lower legs between the platform and the at least one foot portion, acting to bias the platform away from the at least one foot member.

12. An apparatus as claimed in claim 11 wherein the resilient separator is an internally, concentrically mounted spring within the at least one upper and/or at least one lower legs between the platform and the at least one foot portion, for biasing the platform away from the at least one foot member.

13. An apparatus as claimed in claim 1 wherein an engagement finger is associated with a lower end of the elongate lever.

14. An apparatus as claimed in claim 13 wherein the lever is mounted about a pivot point allowing the lever to reciprocate to move the engagement finger between an engaged condition to lock the height of the height adjustment assembly and a disengaged condition allowing movement of the height adjustment assembly.

15. An apparatus as claimed in claim 13 wherein the engagement finger is shaped having a rounded end.

16. An apparatus as claimed in claim 13 wherein an engagement assembly is provided on the engagement finger in order to hold the engagement finger in the opening against accidental but not determined dislodgement.

17. An apparatus as claimed in claim 1 wherein the elongate lever is provided at least partially within a portion of an outer tubular leg member and adapted for rotation about a substantially horizontal axis.

18. An apparatus as claimed in claim 1 wherein the elongate lever is provided at least partially within a portion of an outer tubular leg member and adapted for rotation about a substantially vertical axis.

19. An apparatus as claimed in claim 1 wherein a latch or other mechanism is provided to minimize accidental dislodgement of locking mechanism whilst the device is in use.

20. An apparatus as claimed in claim 19 wherein the latch requires the use of both hands of the user in order to disengage the latch to allow operation of the locking mechanism.

* * * * *